United States Patent [19]

Stoy et al.

[11] Patent Number: 4,615,202

[45] **Date of Patent: * Oct. 7, 1986**

[54] SIX-HIGH ROLLING STAND

[75] Inventors: Erich Stoy, Ratingen; Hans Römmen, Dormagen, both of Fed. Rep. of Germany

[73] Assignee: SMS Schloemann-Siemag AG

[ * ] Notice: The portion of the term of this patent subsequent to Oct. 1, 2002 has been disclaimed.

[21] Appl. No.: 765,366

[22] Filed: Aug. 13, 1985

Related U.S. Application Data

[63] Continuation of Ser. No. 678,371, Dec. 5, 1984, Pat. No. 4,543,810, which is a continuation of Ser. No. 352,520, Feb. 26, 1982, abandoned.

[30] Foreign Application Priority Data

Feb. 28, 1981 [DE] Fed. Rep. of Germany ..... 3107693
Jun. 4, 1981 [DE] Fed. Rep. of Germany ..... 3122128

[51] Int. Cl.[4] ..... B21B 31/20
[52] U.S. Cl. ..... 72/245; 72/243
[58] Field of Search ..... 72/245, 243, 241, 247

[56] References Cited

U.S. PATENT DOCUMENTS 4,543,810 10/1985 Stoy et al. ..... 72/245

FOREIGN PATENT DOCUMENTS 36303 4/1981 Japan ..... 72/245

*Primary Examiner*—Francis S. Husar
*Assistant Examiner*—Jorji M. Griffin
*Attorney, Agent, or Firm*—Toren, McGeady, Stanger, Goldberg & Kiel

[57] ABSTRACT

A roll stand has a frame in which upper and lower working rolls are journaled for rotation about respective parallel upper and lower working-roll axes and defining a workpiece nip. Respective upper and lower backup-roll guide elements vertically flank the working rolls and are each at least partially vertically displaceable relative to the frame. Respective upper and lower backup-roll journal blocks are axially displaceable but vertically fixed relative to the guide elements and define parallel upper and lower inner axes flanking the working axes. Respective inner backup rolls are journaled in the blocks for rotation about the inner axes and bear radially toward the nip on the working rolls. The inner backup rolls are therefore axially displaceable in the guide elements. A pair of outer backup rolls are journaled in the frame for rotation about outer axes coplanar with the respective inner axes and bear radially toward the nip on the inner backup rolls. Respective vertically effective actuators for exerting a force at least generally parallel to the planes between each journal block and the frame to bend the inner backup rolls and for displacing the force axially relative to the journal blocks.

18 Claims, 11 Drawing Figures

11
8
6
10
1
15
4
13
2
17
18
3
14
5
16
7
9
24
19
23
25
21
22
II
12
21
23
20
24

Fig. 4
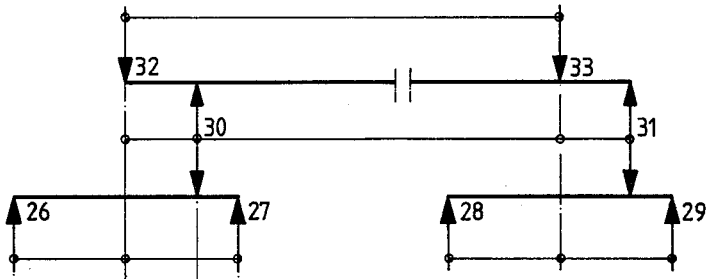
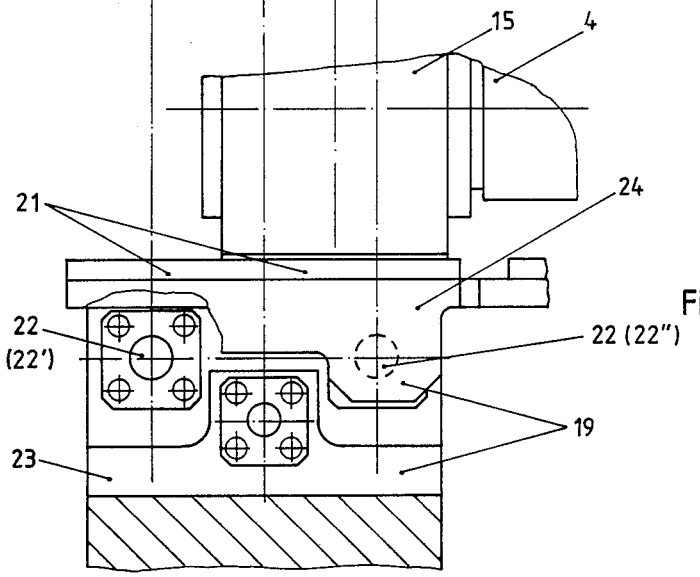
Fig. 3

11
8
6
10
1
37
15
4
37
13
2
17
18
3
14
36
5
16
7
9
35
19
36
38
21
39
34
VI
12
37
36
20
35
37
21

6
α
15
4
42
40
44
41
2
3
16
5
7
45
43

11
8
6
10
1
15
4
13
2
117
118
3
14
5
16
7
9
54
53
57
53
54
24
19
23
25
21
22
II
56
53
117
12
55
54
53
21
23
20
24

11
8
6
10
1
37
15
4
37
59
13
64
2
62
117
58
118
63
3
65
14
59
36
5
16
7
9
35
19
36
38
21
39
34
IV
58
117
61
12
59
118
37
36
20
35
37
21

SIX-HIGH ROLLING STAND

This is a continuation of application Ser. No. 678,371, filed Dec. 5, 1984, U.S. Pat No. 4,543,810 issued Oct. 1, 1985 which in turn, is a continuation of application Ser. No. 352,520, filed Feb. 26, 1982, now abandoned.

FIELD OF THE INVENTION

The present invention relates to a six-high rolling stand. More particularly this invention concerns such a stand whose intermediate or inner backup rolls are axially shiftable.

BACKGROUND OF THE INVENTION

A standard six-high rolling stand of the type used for rolling strip steel has a pair of vertically spaced nip-defining working rolls of relatively small diameter. Respective upper an lower inner backup rolls of larger diameter bear respectively down and up toward the nip on the respective working rolls, and respective upper and lower outer backup rolls of still larger diameter bear toward the nip on the respective inner backup rolls. Thus the bendability of the small-diameter working rolls is largely canceled out by the rigidity of the larger-diameter backup rolls so that the large forces required for rolling can be brought to bear on the workpiece.

Even with such a system the workpiece is normally subjected to somewhat more pressure at its longitudinal edges than at its center so that the working rolls wear more at their portions corresponding to the edges of the strip being rolled. Old German patent 955,131 suggests that this problem can be somewhat alleviated by axially oppositely shifting the two inner backup rolls so that one end of the one working roll and the opposite end of the other working roll are not backed up. This allows some deformation of the working rolls in the corresponding regions and thereby ensures more uniformity of workpiece thickness. Such axial shifting of the inner backup rolls allows the stand to be adjusted for the particular workpiece width exactly to produce a rolled product of relatively uniform thickness. In order further to prevent the workpiece from being left slightly too thick at its edges, the working rolls in this system are somewhat crowned, that is are of somewhat greater diameter at their centers than at their ends.

It is also possible to use perfectly cylindrical working rolls in a system such as described in German patent publication No. 1,281,981. Here the ends of the working rolls are pushed inwardly in a direction bowing these rolls toward the nip. The ends of these working rolls are supported on the stand frame or housing in journal blocks which are urged by actuators with great force toward the nip to achieve this effect.

British patent application No. 678,285 suggests a similar system wherein both the working and inner backup rolls have their ends mounted in journal blocks that can be pushed by appropriate actuators toward the nip so as to bow the ends of the working roll that extend past the workpiece strip edge toward each other. Such an arrangement allows cylindrical working rolls to be employed. In addition the actuators for at least the upper inner backup roll are useful, when double-acting, to lift this roll out of contact with the respective working roll when the working rolls have to be replaced.

It is also known from German patent publication No. 2,752,750 to use axially fixed rolls in a six-high stand wherein each inner backup roll is axially somewhat shorter than the respective working roll, and similarly each outer backup roll is somewhat shorter than the respective inner backup roll. In this arrangement actuators are provided for bending the ends of the inner backup and working rolls inwardly toward the working nip to compensate for their not being supported. Thus the edges of the rolls turned toward the nip are made perfectly straight.

The problem with this last-described system is that it is only usable with strip material whose width lies within a very narrow range, as only the end regions of the rolls can be bent. The minimim workpiece width is therefore the axial length of the central portion of the outer backup rolls and the maximum workpiece width is the axial length of the central portion of the inner backup rolls. This limitation of the size of workpiece for the system is a great disadvantage.

OBJECTS OF THE INVENTION

It is therefore an object of the present invention to provide an improved six-high roll stand.

Another object is the provision of such a six-high roll stand which overcomes the above-given disadvantages.

A further object is to provide an improved six-high roll stand which can be used with workpieces of varying width, yet which can be adjusted to produce workpieces of perfectly uniform thickness.

Yet another object is to provide such a roll stand wherein the Hertzian pressure on the rolls is minimized.

Another object is to make it relatively easy to change the working and inner backup rolls.

SUMMARY OF THE INVENTION

These objects are attained according to the instant invention in a roll stand having a frame in which upper and lower working rolls are journaled for rotation about respective parallel upper and lower working-roll axes and defining a workpiece nip. Respective upper and lower backup-roll guide elements vertically flank the working rolls and are each at least partially vertically displaceable relative to the frame. Respective upper and lower backup-roll journal blocks are axially displaceable but vertically fixed relative to the guide elements and define parallel upper and lower inner axes flanking the working axes. Respective inner backup rolls are journaled in the blocks for rotation about the inner axes and bear radially toward the nip on the working rolls. The inner backup rolls are therefore axially displaceable in the guide elements. A pair of outer backup rolls are journaled in the frame for rotation about outer axes coplanar with the respective inner axes and bear radially toward the nip on the inner backup rolls. Means is provided including respective vertically effective actuators for exerting a force at least generally parallel to the planes between each journal block and the frame to bend the inner backup rolls and for displacing the force axially relative to the journal blocks.

In other words, the invention relates to a six-high rolling stand with two working rolls, two inner backup rolls, and two outer backup rolls wherein at least the outer backup rolls and the inner backup rolls are arranged in a vertical plane above each other, wherein additionally the inner backup rolls are axially displaceable between the outer backup rolls and the working rolls, and wherein mounting blocks fixed on the machine frame are provided on one side with vertical guide surfaces for the journal blocks of the working rolls and of the inner backup rolls and on the other side with adjustment means for compensating and bending the rolls, with particular adjustment means effective toward the upper backup roll on the upper inner backup roll. The invention is that the journal blocks of both inner backup rolls are associated with adjustment means in the mounting blocks acting as benders, that a lower and an upper guide piece provided with the guide surfaces for the journal blocks is vertically shiftable on each mounting block, and that the adjustment means forming the bending device for the inner backup rolls is horizontally displaceable parallel to the roll axes relative to the journal blocks and/or to the guide pieces.

Such a system greatly reduces wear on the working rolls, because these rolls are not corrected over the edges of the inner backup rolls. In addition it is advantageous that the bend-lever arm of the axially shiftable inner backup roll remains constant for all widths of material being rolled. The inner backup rolls are relatively easy to shift axially in the stand of the instant invention also. The system can also be relatively easily built into a roll stand without taking up significant space or limiting roll size.

According to another feature of this invention each of the guide elements has an outer part generally fixed in the frame and an inner part axially nondisplaceable but vertically displaceable relative to the respective outer part. The actuators are braced between the inner and outer parts of the respective guide elements.

In accordance with this invention each of the journal blocks is associated with a respective pair of such actuators spaced axially from each other. Thus the force or bend-lever arm is adjusted axially by varying the relative forces exerted by the actuators of each pair. To this end each of the actuators is built into the respective outer part and engages the respective inner part.

More particularly, each of the guide elements has an outer part generally fixed in the frame and an inner part axially and vertically displaceable relative to the respective outer part. The actuators are braced between the inner and outer parts of the respective guide elements and each lies axially generally level with the center plane of the respective journal block.

Each of the guide elements may also be formed as an outer part generally fixed in the frame, an inner part axially and vertically displaceable relative to the respective outer part and vertically fixed to the respective journal block, and an intermediate part axially fixed but vertically displaceable relative to the respective inner part and axially displaceable but vertically fixed relative to the respective outer part. The actuators are braced between the inner and intermediate parts of the respective guide elements. In this case each of the actuators is a vertically effective hydraulic piston-and-cylinder arrangement braced between the respective parts. When these arrangements are double acting the system can open up to replace the working and inner backup rolls easily.

According to a further feature of this invention the stand comprises respective upper and lower working-roll guide elements level with the working rolls and each at least partially vertically displaceable relative to the frame, respective upper and lower working-roll journal blocks axially displaceable but vertically fixed relative to the respective guide elements and defining the working axes, and means including respective vertically extensible and contractile actuators for exerting a force at least generally parallel to the planes between each working-roll journal block and the frame to bend the working rolls and for displacing the force axially relative to the working-roll journal blocks. More particularly the upper and lower working-roll guide elements each have an outer part fixed to the frame and an inner part vertically displaceable relative to the respective outer part, the actuators being braced between the inner and outer parts of the respective working-roll guide elements. The inner and outer parts of the working-roll guide elements are axially nondisplaceable relative to each other and the actuators of the working-roll guide elements are built into the respective outer parts and engages the respective inner parts. Such an arrangement allows the working rolls to be adjusted perfectly to produce a rolled product of perfectly uniform thickness.

In addition in such an arrangement the actuators of the working-roll guide elements are built into the respective inner parts and engages the respective outer parts. Moreover each of the actuators of the working-roll guide elements is a vertically effective hydraulic piston-and-cylinder arrangement braced between the respective parts, and these actuators are double acting.

In accordance with another feature of this invention means is provided for spacing the working rolls apart by a predetermined distance. This means includes respective piston-and-cylinder arrangements effective between the working-roll journal blocks. Each such piston-and-cylinder arrangement in turn includes a pair of aligned cylinders formed in the inner parts of the working-roll guide elements, and a pair of axially linked double-acting pistons in the cylinders and braced against the frame.

DESCRIPTION OF THE DRAWING

The above and other features and advantages will become more readily apparent from the following, reference being made to the accompanying drawing in which:

FIG. 3 is a partly sectional top view of the detail of FIG. 2;

FIG. 4 is a force diagram illustrating the arrangement of FIGS. 1–3;

SPECIFIC DESCRIPTION

Figure 1:
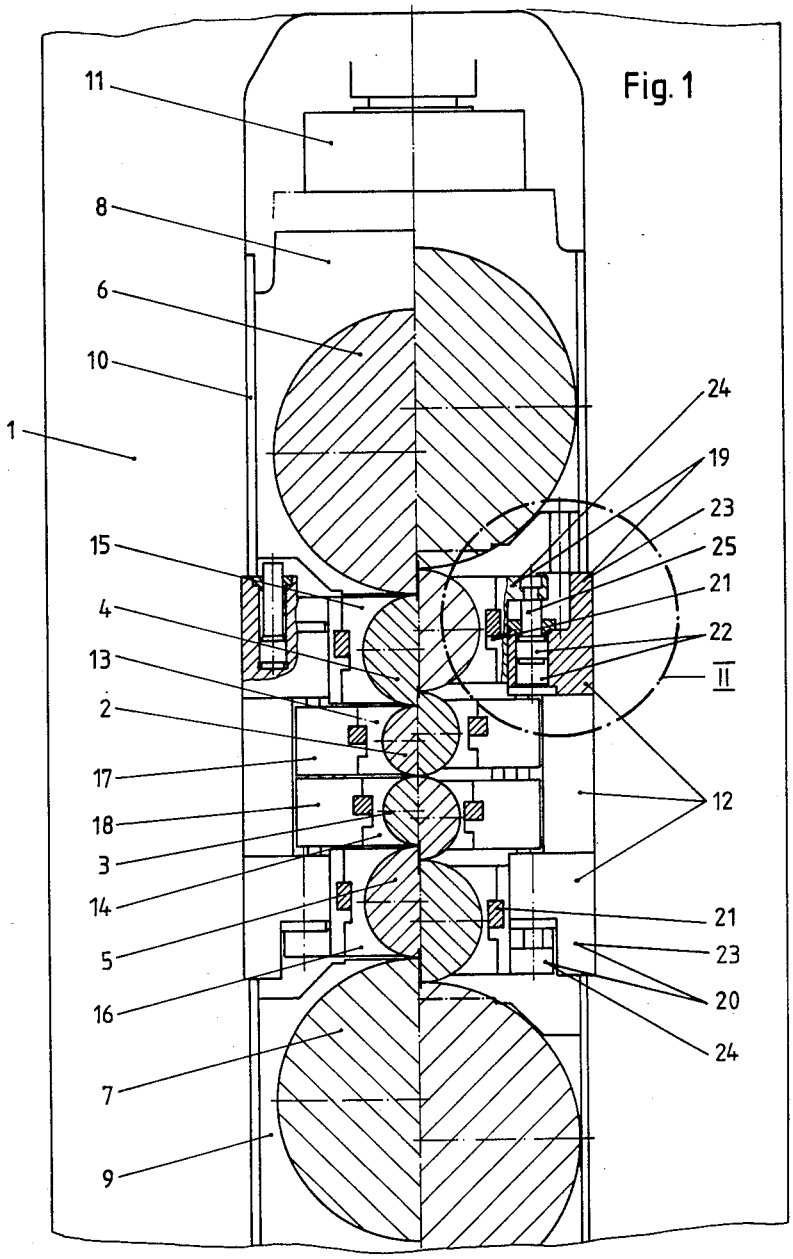
FIG. 1 is a vertical section through a six-high stand according to this invention.
Figure 2:
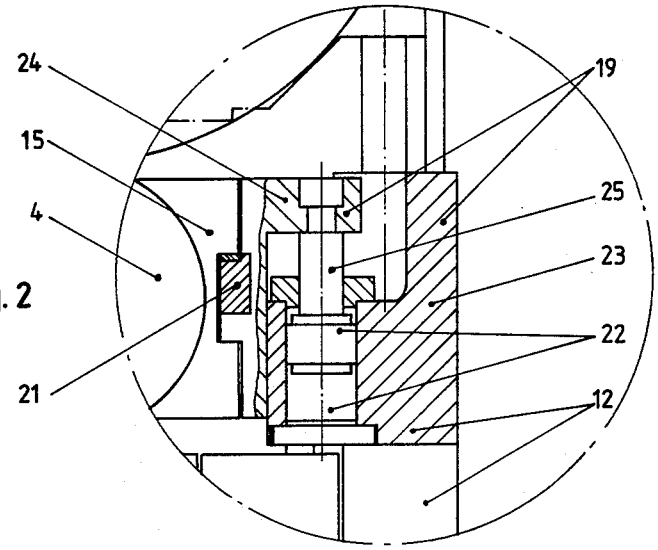
FIG. 2 is a large-scale view of the detail indicated at II in FIG. 1.

As seen in FIGS. 1–3 a six-high roll stand has a roll housing 1 provided with two working rolls 2 and 3, two inner backup rolls 4 and 5, and two outer backup rolls 6 and 7 rotatable about respective axes 2A, 3A, 4A, 5A, 6A, and 7A that are parallel to one another and that lie in a common vertical plane P. The upper and lower outer backup rolls 6 and 7 are supported by standard bearings at their ends in respective journal blocks 8 and 9 mounted directly in the housing window 10. The hydraulic rams 11 that exert the principal force on a workpiece passing through a nip 46 defined between the confronting edges of the working rolls 2 and 3 engage the two journal blocks 8 of the upper outer backup roll 6.

The working rolls 2 and 3 have journal blocks 13 and 14 that have axially extending guide bars 21' so as to be vertically nondisplaceable but axially slidable relative to respective guide elements 17 and 18 with which the guide bars or ridges 21' fit. These elements 17 and 18 in turn are vertically shiftable relative to mounting blocks 12 fixed in the housing window 10 at the level of the working rolls 2 and 3. Thus it is possible to slide the rolls 2 and 3 out of the housing 1 parallel to their axes 2A and 3A to change them.

Similarly the upper and lower inner backup rolls 4 and 5 have respective journal blocks 15 and 16 having axially extending guide bars 21 engaging in respective guide elements 24 so that these blocks 15 and 16 are vertically nondisplaceable but axially slidable relative to the respective guide elements 24. Thus the inner backup rolls 4 and 5 also can be changed by pulling them axially out of the machine. In addition these guide bars 21 allow the rolls 4 and 5 to be axially shifted by means such as shown at 19 relative to the rolls 2 and 3 on one side and the rolls 6 and 7 on the other. The guide elements 24 for the journal blocks 15 and 16 are in turn vertically limitedly displaceable transverse to the axes 2A–7A relative to respective outer guide elements 23 that are axially fixed in the housing like the blocks 12. The systems for the upper and lower inner backup rolls 4 and 5 are identical but mirror symmetrical. The machine itself is symmetrical about the plane P and a plane P' perpendicular thereto and passing through the working nip 46 between the working rolls 2 and 3. Vertically extending and horizontally interengaging formations on the outer and inner guide elements 23 and 24 prevent them from moving axially relative to each other.

The axial shifting means 19 can be respective double-acting hydraulic rams connected to the blocks 15 and 16 and is provided for axially shifting the rolls 4 and 5. This axial displacement of these inner backup rolls 4 and 5 permits the rolling stand to be adjusted to roll strips of different width without excessively compressing the strip at its longitudinal outer edges and without excessively wearing the rolls 2 and 3 at the corresponding regions.

It is necessary, when rolling strip stock of different widths, to minimize the Hertzian pressure between the working rolls and the inner backup rolls and to employ working and backup rolls of diameters determined by the workpiece and the rolling force being used. To this end the stand according to this invention is provided between each of the journal blocks 15 and 16 and the respective fixed mounting block 12 with a pair of actuators 22 and 22' (see FIG. 3) each having a piston 25 vertically displaceable in a pressurizable hydraulic cylinder 20 formed in the outer guide element 23 that is relatively stationary as best seen in FIGS. 2 and 3. The piston 25 is fixed to the inner guide element 24 so that pressurization of the cylinder 20 above the piston 25 will push the end of the roll 4 of the journal block 15 down toward the nip 46. Pressurization of the cylinder 20 below the piston 25 will raise the respective end of the roll 4 to allow the working rolls 2 and 3 to be switched.

FIG. 3 shows how the two actuators 22 and 22' are spaced apart along the respective axis 4A and together form the bender for the respective side of the journal block 15, there being overall eight actuators bearing on the roll 4. These two actuators 22 and 22' serve to hold the bending-lever arm of the roll 4 constant. To this end their pressurization is varied according to the axial position of the respective block 15. In the full-right axial position of FIG. 3 the actuator 22 exerts substantially more force than the actuator 22'. In the full-left position of the block 15 the situation would be opposite, with the actuator 22' exerting substantially more force than the actuator 22. In the central position of the roll 4 the forces of the two actuators would be identical, with the change from one condition to another being stepless and being directly and proportionately related to axial roll position. The two forces of the actuators 22 and 22' net to one force on the respective side of the block 15 and this net force is the same for the other three net forces applied by the other three pairs of actuators 22 and 22' bearing on the respective roll 4. In other words the bend-lever arm for the inner backup roll 4 always engages in the central plane P'' of the respective journal block, here the block 15, which plane P'' is perpendicular to the planes P and P'.

These forces are illustrated in FIG. 4, where arrows 26 and 27 represent the forces of the outer and inner actuators 22 and 22', respectively, arrows 28 and 29 the forces of the two actuators 22' and 22 at the other end of the roll 4 but on the same side of the plane P. Arrows 30 and 31 lie on the planes P'' of the respective blocks 15 and arrows 32 and 33 respresent the forces resisting bending of the inner backup roll 4. The positions of the double-headed arrows 30 and 31 on the one side relative to the arrows 26–29 and on the other side relative to the forces 32 and 33 correspond to the axial position of the block 16 and thereby also of the roll 4 with respect to the respective working roll 2 and outer backup roll 6.

Figure 6:
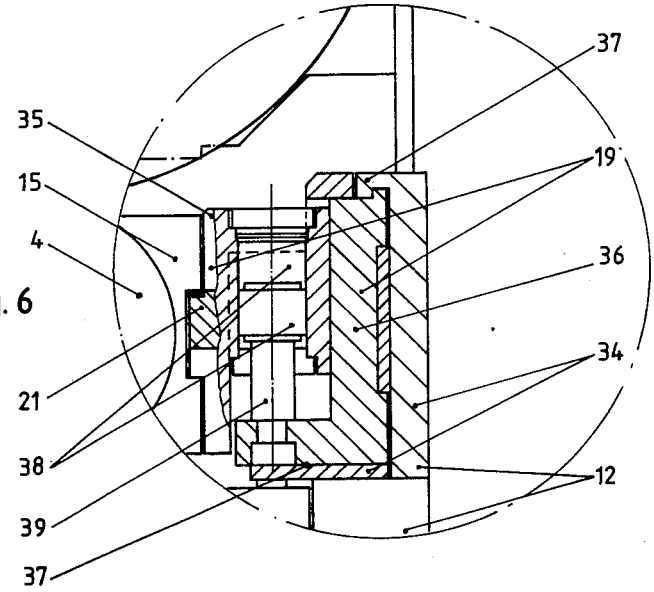
FIG. 6 is a large-scale view of the detail indicated at VI in FIG. 5.
Figure 5:
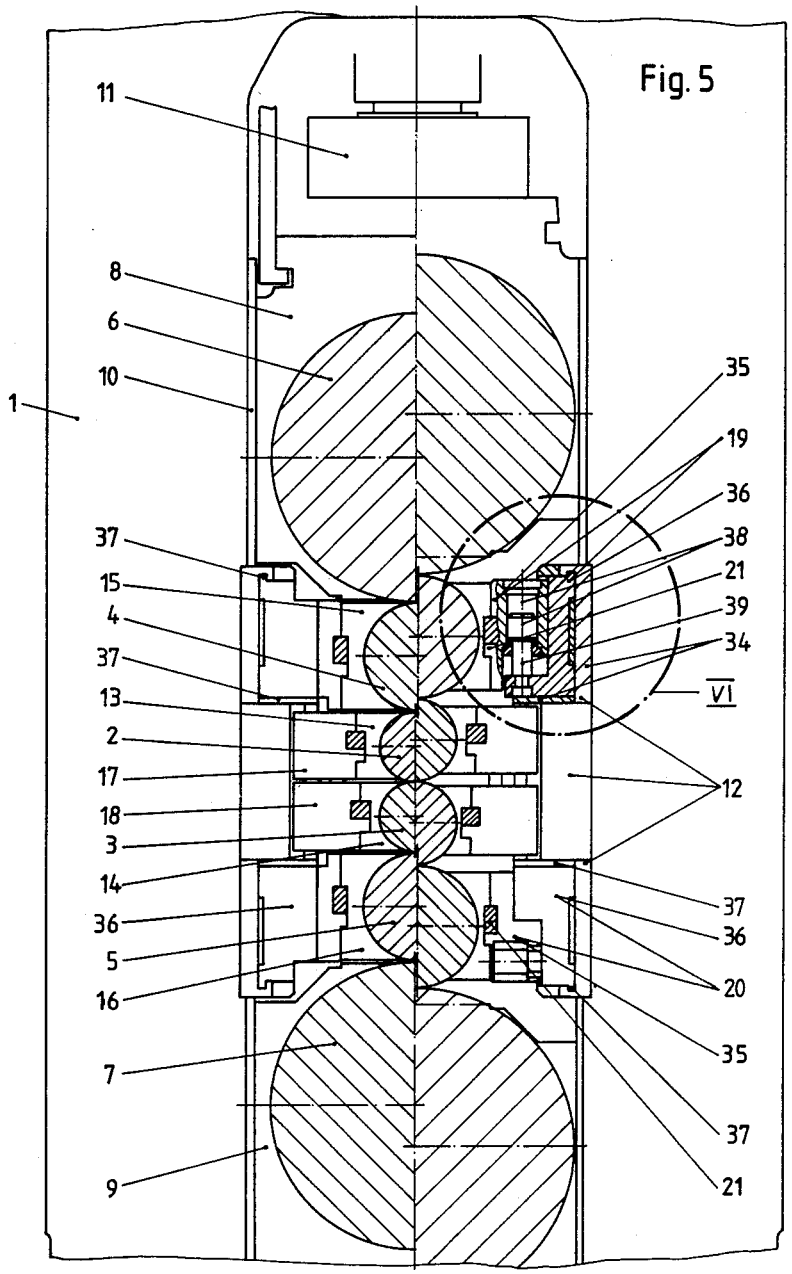
FIG. 5 is a vertical section like FIG. 1 showing a second embodiment of the stand of this invention.

The arrangement of FIGS. 5 and 6 is substantially identical to that of FIGS. 1–4, with the same reference numerals and letters being used for functionally identical structure. In this device the outer guide element 34 equivalent to the element 23 of FIGS. 1–4 is again stationary and associated with a two-part inner guide element 35, 36, having an inner part 35 connected by the bar 21 to the block 15 and an outer part 36 slidable in the outer guide elment 34, with longitudinally extending guides 37 allowing the part 36 to slide axially on the element 34. The parts 35 and 36 of the outer guide element are once again not axially displaceable relative to each other. The freedom of relative axial movement between the blocks 15 and 16 and the respective parts 35 merely serves for switching the rolls 4 and 5 with others. During rolling the parts 35 are locked against movement relative to the blocks 15 and 16.

In this arrangement an actuator 38 is used having a piston 39 fixed to the outer part 36 and slidable in a vertical cylinder 39' formed in the part 36. This actuator 38 is, like the actuators 22 and 22', double acting so that it also can serve to raise at least the upper backup roll 4 when the working rolls 2 and 3 are changed.

The single actuators 38 can each be moved axially relative to the respective rolls 4 and 5. Thus each actuator 38 lies in the central plane P'' of its respective journal block 15 or 16 and in fact is fixed to it at this level. When the respective roll 4 or 5 is axially positioned, therefore, the respective actuators 38 will automatically be positioned with it so that the bend-lever arm remains the same. The system of FIGS. 5 and 6 is hence a simplified version of that of FIGS. 1–4 where the forces of two axially spaced actuators 22 and 22' are netted to lie at the plane P'; and in FIG. 5 and 6 the actuator itself is moved to lie at this plane. Both systems keep this critical force at just the right location, regardless of the axial position of the respective inner backup roll.

Both of the above-described systems are advantageous in that neither system takes up much room, or in fact any useful room in the roll stand. Thus these systems can be used with a wide range of different roll diameters, and can in fact be adjusted to accommodate them all. Both systems substantially reduce the Hertzian pressure between the working rolls and the inner backup rolls. The thus created temperature gradient on the working rolls greatly reduces scaling. Wear is also substantially reduced in the working rolls, as the working rolls are not corrected over the edges of the inner backup rolls.

Figure 7:
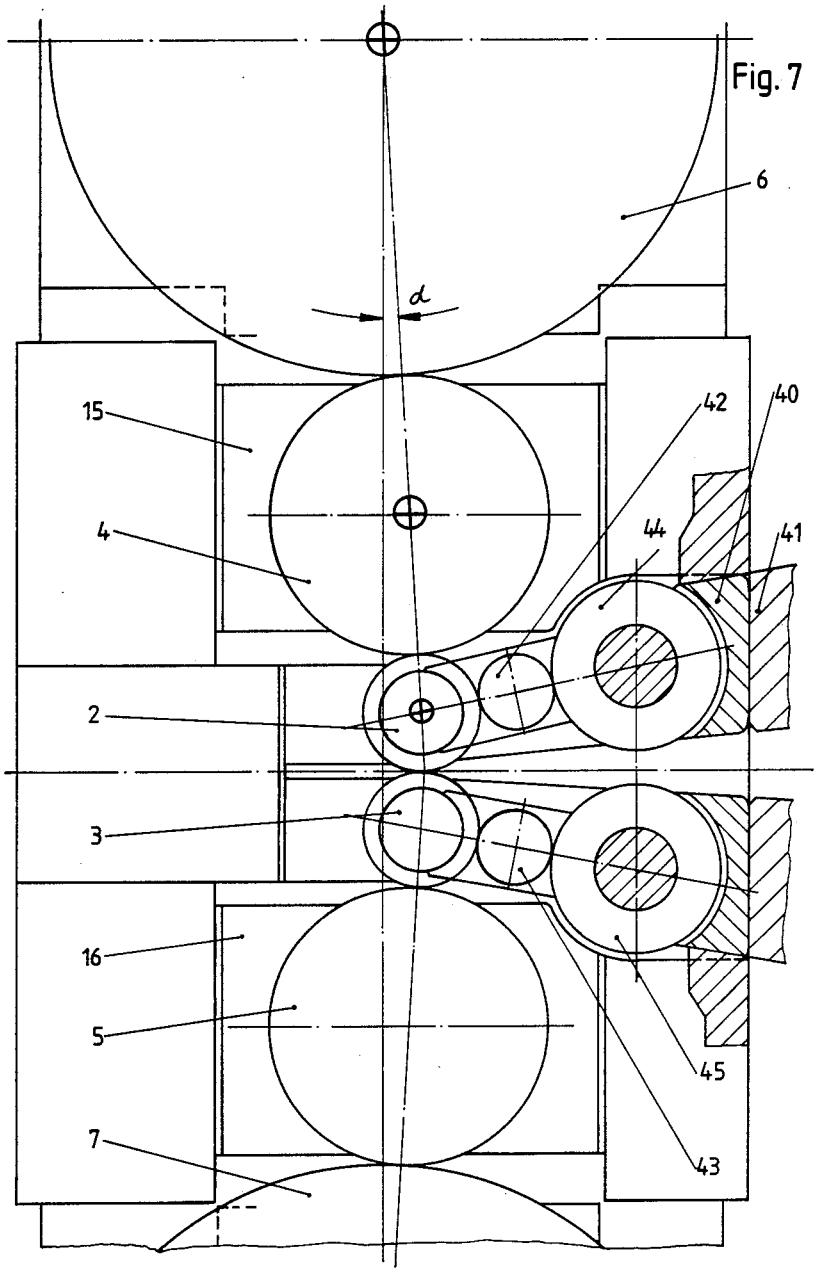
FIG. 7 is a vertical section showing a third embodiment of the invention.

In the arrangement of FIG. 7 the working rolls 2 and 3 are carried on elements 40 and 41, respectively, that hold their axes 2A and 3A slightly offset from the plane P''' defined by the axes 6A and 7A of the outer backup rolls 6 and 7. Instead the axes 6A, 4A, and 2A form an upper plane $P_1$ and the axes 3A, 5A, and 7A (not shown) a plane $P_2$ that meet at the roll nip 46. The rolls 2 and 3 engage respective lateral backup rolls 42 and 43 that bear in turn against larger bracing rolls 44 and 45 also carried on the respective bridges or elements 40 and 41. In this arrangement, which is similar to that shown in German patent document No. 1,522,213, the blocks 15 and 16 are provided with actuators such as shown in FIGS. 1–6.

Figure 8:
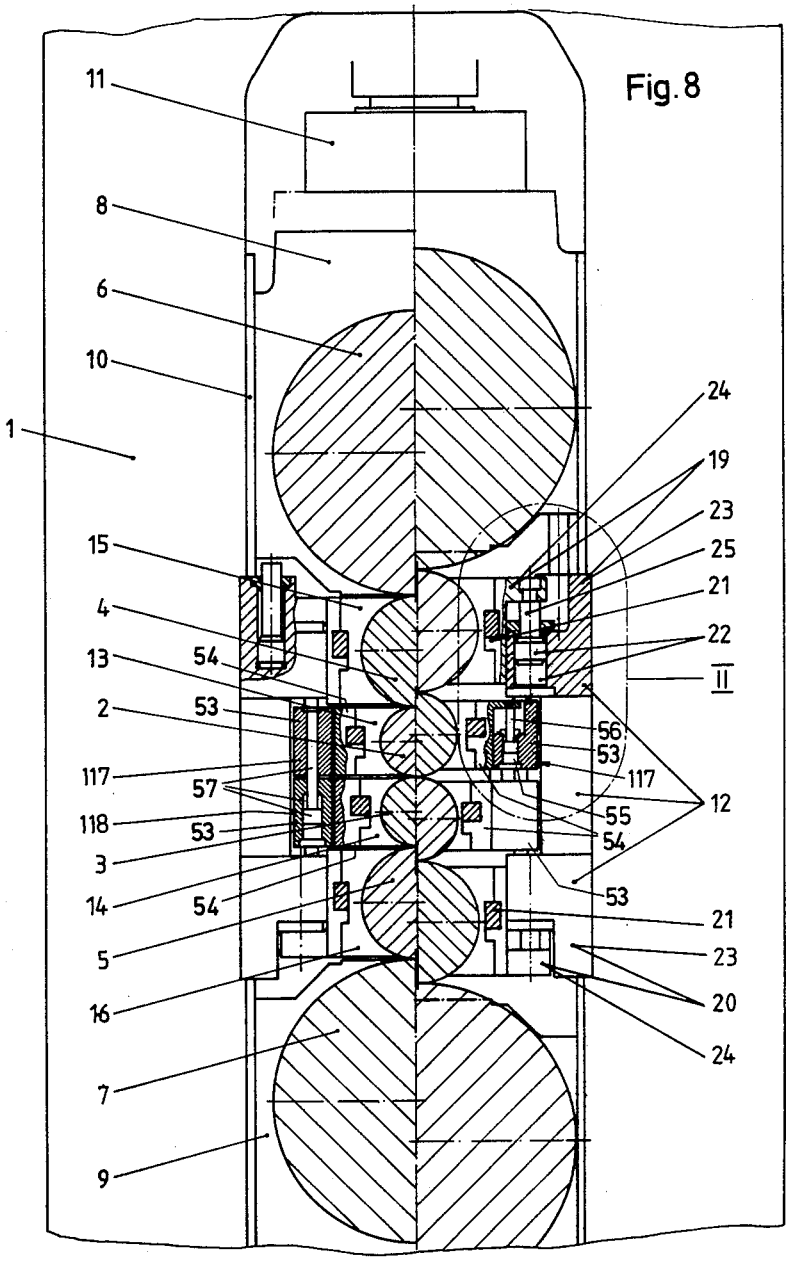
FIG. 8 is a vertical section showing a fourth embodiment of the invention.
Figure 9:
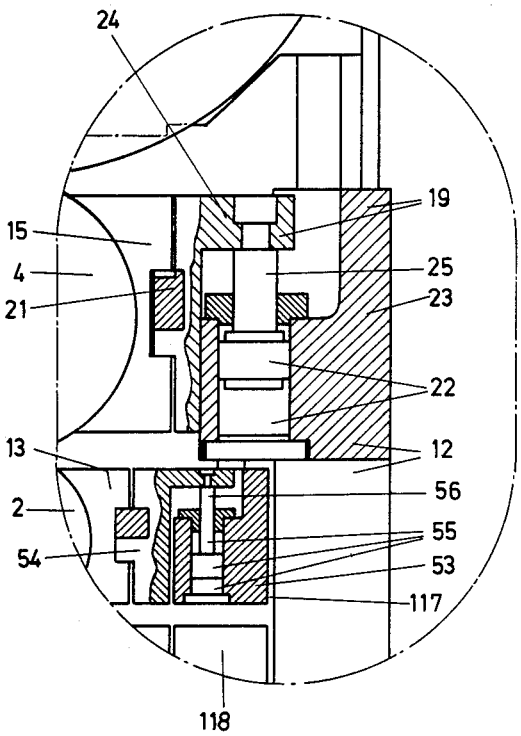
FIG. 9 is a large-scale view of the detail indicated at IX in FIG. 8.

In FIGS. 8 and 9 the system is substantially identical to that of FIGS. 1–4, except that here benders are provided for the working rolls 2 and 3. Guide elements 117 and 118, roughly equivalent to the elements 17 and 18 of FIGS. 1–4, are each formed of a pair of vertically relatively displaceable parts 53 and 55, the former fixed on the respective block 12 and the latter carrying the respective journal block 13 or 14 by means of a guide ridge or rail 21''. The parts 53 each are provided with an actuator 55 having a piston 56 fixed to the other respective part 54 and double-acting so it can urge the respective end of the roll 2 or 3 up or down.

The parts 53 of the guide elements 117 and 118 are preferably braced by abutments against the blocks 12 and/or against each other so that their respective parts 54 and the journal blocks 13 and 14 carried thereby can be positioned by the respective actuators 55 independently of the position of the fixed parts 53.

These abutments are formed in FIG. 8 as piston-and-cylinder arrangements which interconnect the inner parts 53 of the two guide elements 117 and 118 so that they can establish a rough nip height without in any way limiting vertical displaceability of the thus gapped rolls 2 and 3. Independently of this possibility of relative shifting of the working rolls 2 and 3 vertically to the block 12, the actuators 55 can bend the working rolls 2 and 3 in either direction vertically in order to appropriately affect the rolling operation.

The combination of bending the working rolls 2 and 3 and the inner backup rolls 4 and 5 allows the workpiece thickness to be controlled very exactly, to produce rolled workpieces of perfectly uniform thickness. In addition optimizing the gap pressure on the one hand between the working rolls and on the other hand between each inner backup roll and the respective outer backup roll becomes possible, so that not only is roll wear reduced, but also the rolls and their bearings are less heavily stressed. Finally bending of the inner backup rolls can correct the profile of the outer backup rolls while simultaneously allowing the working rolls to affect the rolling process.

Figure 10:
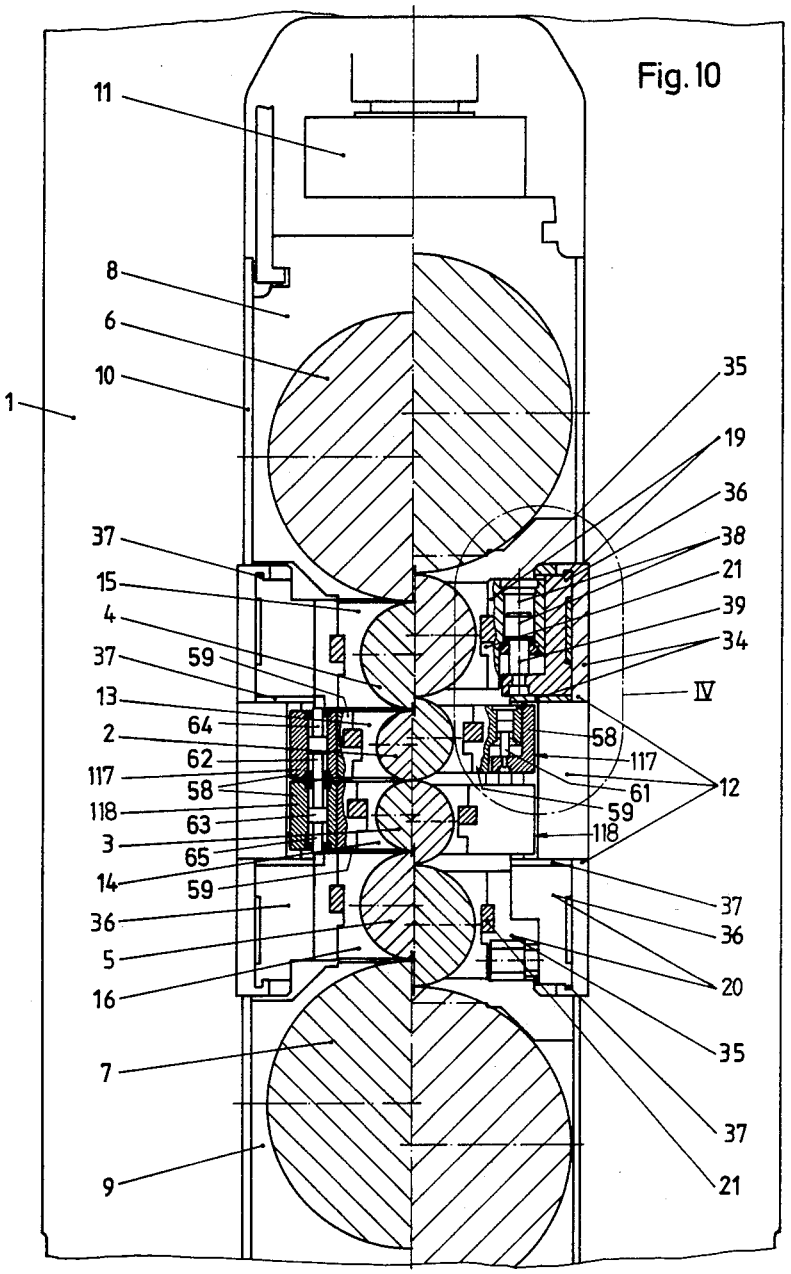
FIG. 10 is a vertical section showing a fifth embodiment of the invention.
Figure 11:
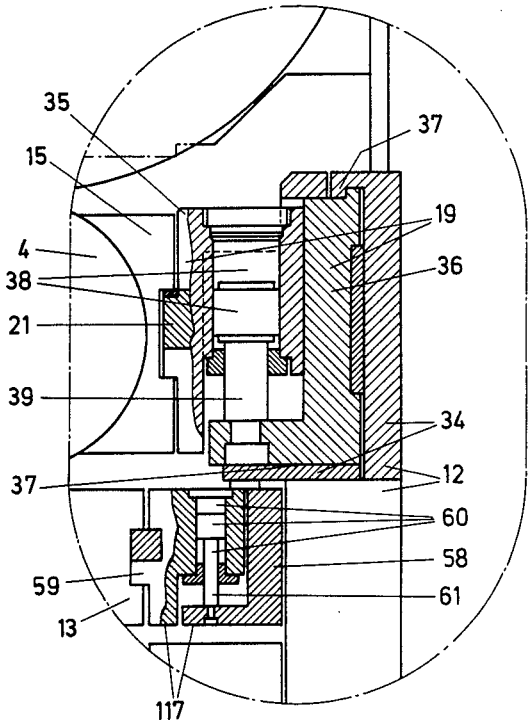
FIG. 11 is a large-scale view of the detail indicated at XI in FIG. 8.

In FIGS. 10 and 11 an arrangement quite similar to that of FIGS. 8 and 9 is seen. Here the upper guide element 117, which is identical to the lower guide element 118, is formed by an outer part 58 fixed on the frame 1 and an inner part 59 secured to the respective side of the journal block 13. An actuator 60 has a piston 61 secured to the part 58 and riding in a vertical cylinder formed in the part 59. This actuator 60 is, once again, double acting and the piston 61 is fixed in the part 58.

As mentioned with reference to FIGS. 8 and 9, it is advantageous to provide the guide elements 117 and 118 for the journal blocks 13 and 14 of the working rolls 2 and 2 with abutments so that on the one hand the relative position between the guide elements 117 and 118 and on the other their position relative to the fixed mounting block 12 can be adjusted, without at the same time needing a change in the relative position between the parts 58 carried on the frame 1 and the parts 59 carried on the journal blocks, such change to be made by the actuator 60.

This can be done as best seen in FIG. 10 at the left-hand guide elements 117 and 119 for the blocks 13 and 14 of the rolls 2 and 3 by providing double-acting piston-cylinder arrangements 62 and 63 that have pistons 64 and 65 that are braced against or coupled to each other. In addition these axially relatively fixed pistons 64 and 65 are fixed relative to the frame 1, as they vertically abut surfaces of the fixed mounting block 12. Thus these actuators 62 can position the parts 58 anywhere relative to each other and to the frame 1, without affecting what is being done by the respective actuators 60.

The system according to the instant invention allows the inner backup rolls to be bent, or at least to have their outer ends urged toward the nip, with a pressure that can be exactly calculated to the particular requirements of the rollers, as well as to the workpiece. The bend-lever arm or the axial extension of working roll beyond the end of the surface of the inner backup roll can be kept perfectly constant so that as the inner backup roll is shifted it does not become so great as to score the working roll. In addition the system can be adjusted so that with wide or narrow workpieces, the resultant workpiece thickness is perfectly uniform from one edge to the other of the workpiece. When the system is augmented with an arrangement for also bending the working rolls, this adjustability becomes even more finely tuned, that is it can be set to produce an extremely even workpiece. Finally addition of a stop arrangement to set the initial workpiece gap further lets the entire machine be set up before a run is started and before a workpiece is even engaged through it.

We claim:

1. In a six-high roll stand of the kind having a frame, two working rolls (2, 3), two intermediate rolls (4, 5) and two outer back-up rolls (6, 7), wherein at least the outer back-up rolls (6, 7) and the intermediate rolls (4, 5) are located one above the other essentially in the same vertical plane, wherein the intermediate rolls (4, 5) are arranged so as to be axially displaceable between the outer back-up rolls (6, 7) and the working rolls (2, 3) and wherein blocks (12), secured to said frame, have vertical guide surfaces for journal chocks (13, 14) of the working rolls (2, 3) and vertical guide surfaces for journal chocks (15, 16) of the intermediate rolls (4, 5), and wherein, moreover, adjusting means (22) are provided for the balancing and bending of the intermediate rolls (4, 5), which adjusting means (22) are adapted to act on said journal chocks (15, 16) of the intermediate rolls (4, 5) with their operating force being directed against the outer back-up rolls (6, 7) and wherein said adjusting means (22) for effecting bending of the intermediate rolls (4, 5) are displaced in a horizontal direction parallel to the roll axes, the improvement which comprises that (a) said adjusting means (22) for bending the intermediate rolls (4, 5) are seated in said blocks (12) secured to said frame;

(b) at each of said blocks (12) is arranged a lower (20) and an upper (19) guide piece displaceable in vertical direction, each of said guide pieces (19, 20) being provided with guide surfaces for guiding the respective journal chocks (15 and 16) of the intermediate rolls (4 and 5);

(c) said journal chocks (15, 16) are capable of displacement in a horizontal direction relative to the operational position of the adjusting means (22) and/or the operational position of the adjusting means (22) is varied in its horizontal direction (20', 22') within the guide pieces (19, 20);

(d) each guide piece (19, 20) has a part (23) on the frame and a part (24) associated with the respective journal chock (15, 16) of the intermediate rolls (4, 5);

(e) the two said parts (23, 24) of the guide pieces (19, 20) are displaceable relative to each other exclusively in vertical direction;

(f) between said parts (23, 24) two adjusting means (22, 22', 22''), spaced one behind the other, engage as a bending device in axial direction of the intermediate rolls (4, 5);

(g) said journal chocks (15, 16) of the intermediate rolls (4, 5) are arranged so as to be exclusively displaceable horizontally (21; FIGS. 1 to 3) relative to the associated parts (24) of the guide pieces (19, 20);

(h) the two adjusting means (22, 22', 22'') which are spaced one behind each other are variable with respect to their displacement forces in dependence on the respective axial position of the journal chocks (15, 16) of the intermediate rolls;

(i) said journal chocks (13, 14) of said two working rolls (2, 3) moreover being provided with adjusting means (55; 60) arranged in said blocks (12) and acting as bending means, said adjusting means (55; 60) engaging guide elements (117 and 118, respectively), said guide elements on the one hand being held in said blocks (12) by means of vertical guides (53, 54 and 58, 59, respectively) and on the other hand said guide elements having horizontal guides (54 and 59, respectively) for said journal chocks (13, 14; FIGS. 8–11).

2. The improvement of claim 1, wherein each guide element (117 and 118, respectively) comprises a first part (53 and 58, respectively) on the frame side and a second part (54 and 59, respectively) associated with the journal chock (13 and 14, respectively) of the working roll (2 or 3), said adjusting means (55, 60) forming said bending means being arranged between said first and second parts (53, 54 and 58, 49, respectively).

3. The improvement of claim 2, wherein said two parts (53, 54 and 58, 59) of the guide elements (117, 118) are movable relative to each other exclusively in the vertical direction, while the journal chocks (13, 14) of the working rolls (2, 3) are movable relative to their associated parts (54, 59) of the guide elements (17, 18) exclusively in the horizontal direction (FIGS. 9 and 10).

4. The improvement of claim 1, wherein the adjusting means (55) forming the bending means are built into the part (53) of the guide elements (117, 118) on the frame side and engage at the part (54) on the side of the journal chock (56, FIG. 9).

5. The improvement of claim 1, wherein the adjusting means (60) forming the bending means are built into the part (59) of the guide elements (117, 118) and engage at the part (58) on the frame side (61; FIG. 11).

6. The improvement of claim 1, wherein the adjusting means (55 and 60, respectively) consist of hydraulically chargeable piston-cylinder units which are built into one of said parts (53 and 59, respectively) of the guide elements (117 and 118) and whose piston rod (56 and 61, respectively) engages at the other of said parts (54 and 58, respectively; FIGS. 9 and 11, respectively).

7. The improvement of claim 1, wherein said adjusting means (55; 60) are of double acting construction and engage between said guide elements (117, 118) so as to be capable of bearing tensile and compressive loads.

8. The improvement as claimed in claim 1, wherein adjustable counter acting elements (57 and 62, 63) are arranged to cooperate with the parts (53 and 58, respectively) of the guide elements (117, 118) within the blocks (12) of the roll stands (1) by means of which the relative position of the parts (53 and 58, respectively) of the guide elements (117 and 118) relative to each other and to the blocks (12) can be determined.

9. The improvement as claimed in claim 8, wherein the adjustable counter acting elements (57 and 62, 63, respectively) comprise piston-cylinder units which are built in the parts (53 and 58, respectively) of the guide elements (117, 118) on the frame side.

10. In a six-high roll stand of the kind having a frame, two working rolls (2, 3), two intermediate rolls (4, 5) and two outer back-up rolls (6, 7), wherein at least the outer back-up rolls (6, 7) and the intermediate rolls (4, 5) are located one above the other in essentially the same vertical plane, wherein the intermediate rolls (4, 5) are arranged to be axially displaceable between the outer back-up rolls (6, 7) and the working rolls (2, 3), and wherein blocks (12) are secured to said frame and are provided with vertical guide surfaces for journal chocks (13, 14) of the working rolls (2, 3) and with vertical guide surfaces for journal chocks (15, 16) of the intermediate rolls (4, 5), and wherein adjusting means (38) for the balancing and bending of the intermediate rolls (4, 5) are provided, which adjusting means (38) are adapted to act on said journal chocks (15, 16) of the intermediate rolls (4, 5) with their operating force being directed against the outer back-up rolls (6, 7) and wherein said adjusting means (38) are displaceable in a horizontal direction parallel to the roll axes, the improvement which comprises that (a) said adjusting means (38) for causing bending are arranged in the blocks (12) on said frame;

(b) at each block (12) a lower (20) and an upper (19) guide piece is arranged, said guide pieces (20, 19) being displaceable in vertical direction and having guide surfaces for the journal chocks (16, 15) of the intermediate rolls (4, 5);

(c) the horizontal displacement of the adjusting means (38) relative to the journal chocks (15, 16) is effected within the guide pieces (19, 20);

(d) each guide piece (19, 20) has a part (34) on the frame and a part (35) associated with the respective journal chock (15, 16) of the intermediate rolls (4, 5);

(e) the two said parts (34, 35) of the guide pieces (19, 20) are relatively movable to each other in horizontal and vertical direction (36);

(f) between said guide pieces, said adjusting means (38), arranged in the part (35) of the guide pieces (19, 20), is situated on the center plane of the journal chocks (15, 16) of the intermediate rolls;

(g) the part (35) of the guide pieces (19, 20) is connected with the associated journal chock (15, 16) so as to be horizontally displaceable (21) relative to the part (34);

(h) the part (34) is in operative connection with the part (35) of the guide pieces (19, 20) by means of an intermediate part, which intermediate part on the one hand has horizontal slide guides (37) toward the part (34) and on the other hand vertical slides toward the part (35; FIGS. 5 and 6);

(i) said journal chocks (13, 14) of said two working rolls (2, 3) moreover being provided with adjusting means (55; 60) arranged in said blocks (12) and acting as bending means, said adjusting means (55; 60) engaging guide elements (117 and 118, respectively), said guide elements on the one hand being held in said blocks (12) by means of vertical guides (53, 54 and 58, 59, respectively) and on the other hand said guide elements having horizontal guides (54 and 59, respectively) for said journal chocks (13, 14; FIGS. 8–11).

11. The improvement of claim 10, wherein each guide element (117 and 118, respectively) comprises a first part (53 and 58, respectively) on the frame side and a second part (54 and 59, respectively) associated with the journal chock (13 and 14, respectively) of the working roll (2 or 3), said adjusting means (55, 60) forming said bending means being arranged between said first and second parts (53, 54 and 58, 49, respectively).

12. The improvement of claim 11, wherein said two parts (53, 54 and 58, 59) of the guide elements (117, 118) are movable relative to each other exclusively in the vertical direction, while the journal chocks (13, 14) of the working rolls (2, 3) are movable relative to their associated parts (54, 59) of the guide elements (17, 18) exclusively in the horizontal direction (FIGS. 9 and 10).

13. The improvement of claim 10, wherein the adjusting means (55) forming the bending means are built into the part (53) of the guide elements (117, 118) on the frame side and engage at the part (54) on the side of the journal chock (56, FIG. 9).

14. The improvement of claim 10, wherein the adjusting means (60) forming the bending means are built into the part (59) of the guide elements (117, 118) and engage at the part (58) on the frame side (61; FIG. 11).

15. The improvement of claim 10, wherein the adjusting means (55 and 60, respectively) consist of hydraulically chargeable piston-cylinder units which are built into one of said parts (53 and 59, respectively) of the guide elements (117 and 118) and whose piston rod (56 and 61, respectively) engages at the other of said parts (54 and 58, respectively; FIGS. 9 and 11, respectively).

16. The improvement of claim 10, wherein said adjusting means (55; 60) are of double acting construction and engage between said guide elements (117, 118) so as to be capable of bearing tensile and compressive loads.

17. The improvement as claimed in claim 10, wherein adjustable counter acting elements (57 and 62, 63) are arranged to cooperate with the parts (53 and 58, respectively) of the guide elements (117, 118) within the blocks (12) of the roll stands (1) by means of which the relative position of the parts (53 and 58, respectively) of the guide elements (117 and 118) relative to each other and to the blocks (12) can be determined.

18. The improvement as claimed in claim 17, wherein the adjustable counter acting elements (57 and 62, 63, respectively) comprise piston-cylinder units which are built in the parts (53 and 58, respectively) of the guide elements (117, 118) on the frame side.

* * * * *